US006680662B2

(12) United States Patent
Schauwecker et al.

(10) Patent No.: US 6,680,662 B2
(45) Date of Patent: Jan. 20, 2004

(54) DIMENSIONING OF MAGNET ARRANGEMENT COMPRISING AN ADDITIONAL CURRENT CARRYING COIL SYSTEM

(75) Inventors: Robert Schauwecker, Zurich (CH); Pierre-Alain Bovier, Zurich (CH); Andreas Amann, Zurich (CH); Werner Tschopp, Forch (CH)

(73) Assignee: Bruker AG, Faellanden (CH)

( * ) Notice: Subject to any disclaimer, the term of this patent is extended or adjusted under 35 U.S.C. 154(b) by 0 days.

(21) Appl. No.: 09/930,948

(22) Filed: Aug. 17, 2001

(65) Prior Publication Data

US 2003/0095021 A1 May 22, 2003

(30) Foreign Application Priority Data

Aug. 24, 2000 (DE) ..... 100 41 672

(51) Int. Cl.[7] ..... H01F 1/00
(52) U.S. Cl. ..... 335/216; 324/319
(58) Field of Search ..... 335/216; 324/318–321

(56) References Cited

U.S. PATENT DOCUMENTS 4,506,247 A * 3/1985 Vermilyea ..... 335/216
5,633,588 A * 5/1997 Hommei et al. ..... 324/320
5,936,498 A * 8/1999 Takeshima et al. ..... 335/216

OTHER PUBLICATIONS

C. P. Bean "Magnetization of Hard Superconductors" Phys. Rev. Let 8, P 250 ff (1962), (no month).
C. P. Bean "Magnetization of High–Field Superconductors", Rev. Mod. Phys. 36, 31 (1964), (no month).
"Electron Paramagnetic Resonance, ELEXSYS Series" Brochure, Brucker, Nov. 1998, (no month).

* cited by examiner

*Primary Examiner*—Lincoln Donovan
(74) *Attorney, Agent, or Firm*—Paul Vincent

(57) ABSTRACT

In a magnet arrangement (M, D, P1, . . . , Pn) having a magnet coil system (M) with at least one current-carrying superconducting magnet coil, with an additional current-carrying coil system (D) which can be fed by an external current source to produce a magnetic field in the working volume which differs substantially from zero, and optionally with additional superconductingly closed current paths (P1, . . . , Pn), wherein the magnetic fields in the z direction, generated by the additional current paths (P1, . . . , Pn) due to currents induced during operation and the field of the additional current-carrying coil system (D) do not exceed 0.1 Tesla in the working volume, the additional coil system (D) is designed such that its field contribution to the working volume is determined taking into account the diamagnetism of the superconductor in the main coil system. This permits as large as possible an effective field efficiency of the additional coil system (D).

14 Claims, 4 Drawing Sheets

DIMENSIONING OF MAGNET ARRANGEMENT COMPRISING AN ADDITIONAL CURRENT CARRYING COIL SYSTEM

This application claims Paris Convention priority of DE 100 41 672.1 filed Aug. 24, 2000 the complete disclosure of which is hereby incorporated by reference.

BACKROUND OF THE INVENTION

The invention concerns a magnet arrangement for generating a magnetic field in the direction of a z axis in a working volume disposed about z=0, with a magnet coil system having at least one current-carrying superconducting magnet coil, and with one further current-carrying coil system which can be fed via an external current source to produce a magnetic field in the working volume which is substantially different from zero, in particular a magnetic field of an amount >0.2 millitesla per ampere current, and optionally with one or more additional superconductingly closed current paths, wherein the magnetic fields in the z direction produced by induced currents through the additional current paths during operation and the field of the current-carrying coil system in the working volume do not exceed 0.1 Tesla.

A magnet arrangement of this type comprising a superconducting magnet coil system and a further coil system fed via an external current source, however, without additional superconductingly closed current paths, is known e.g. from the EPR (Electron Paramagnetic Resonance) system ELEXSYS E 600/680, distributed since 1996 by the company Bruker Analytik GmbH, Silberstreifen, D-76287 Rheinstetten (company leaflet).

Superconducting magnets are used for different applications, in particular, different magnetic resonance methods. Some of these methods require modulation of the field strength in the working volume during an experiment. In particular, the use of a superconducting magnet has considerable disadvantages if the field modulation is produced through variation of the current in the main coil system. The main coil system typically has a high self-inductance and therefore permits only slow current and field changes.

Connection of current feed lines from the room temperature region to the cooled superconducting magnet during operation disadvantageously affects the cooling of the superconducting magnet coil system. If the region within which the magnetic field strength is to be modulated is not too large (in particular smaller than 0.1 Tesla), field modulation can be produced through varying the current in a coil system which supplements the main coil system.

A further field of use of field-generating additional coils in a superconducting magnet system are so-called superconducting $Z^0$ shim devices. A current change in such a device compensates for a drift in the main coil system over a certain period of time, without having to reset the current in the main coil.

The main focus of the invention is the dimensioning of magnet arrangements having an additional current-carrying coil system which can be fed via an external current source to produce a magnetic field in the working volume which is substantially different from zero, in particular, the dimensioning of magnet arrangements having a superconducting magnet with active stray field compensation and further superconducting current paths.

An additional field-producing coil system in a magnet arrangement must produce a relatively strong field while occupying as little space as possible. To achieve the required field strengths, an additional field-producing coil system must frequently be disposed close to the working volume of the magnet arrangement. This produces undesired "expansion" of the superconducting coil system and associated increased costs.

In contrast thereto, it is the underlying purpose of the present invention to modify a magnet arrangement of the above-mentioned type with as simple means as possible such that an additional field-producing coil system can be integrated in the magnet arrangement which "expands" the main coil system to a lesser extent while nevertheless maintaining the required functions.

SUMMARY OF THE INVENTION

This object is achieved in accordance with the invention in that the efficiency of the additional field-generating coil system is improved by utilizing the interaction between the additional field-generating coil system and the remaining magnet arrangement to produce the field. In addition to inductive couplings between the superconducting magnet coil system and further superconductingly closed current paths, an arrangement in accordance with the invention also uses the diamagnetic behavior of the superconducting material in the superconducting magnet coil system, which is characterized in that field changes of less than 0.1 Tesla, which occur e.g. during charging of an additional field-generating coil system, are expelled from the superconducting volume portion of the magnet coil system.

This manifests itself in a redistribution of the magnetic flux of the field changes in the magnet arrangement which effects the reaction of the superconducting magnet coil system and the additional superconductingly closed current paths to a current change in the additional field-generating coil system, since this reaction is determined by the principle of conservation of the magnetic flux through a closed superconducting loop. The present invention utilizes the interaction between the additional field-generating coil system and the residual magnet arrangement for generating a field such that the variable $g_D^{eff}=g_D-g^T\cdot(L^{cl}-\alpha L^{cor})^{-1}\cdot(L_{\leftarrow D}^{cl}-\alpha L_{\leftarrow D}^{cor})$ is calculated and the magnet arrangement is optimized such that $|g_D^{eff}|>1.2\cdot|g_D^{eff,cl}|$, wherein $$g_D^{eff,cl}=g_D-g^T\cdot(L^{cl})^{-1}\cdot L_{\leftarrow D}^{cl}.$$

These variables have the following definitions:

- $g_D^{eff}$: Field contribution per ampere current of the additional field-generating coil system in the working volume taking into consideration the field contributions of the additional field-generating coil system itself and the field change due to currents induced in the superconducting magnet coil system and additional superconductingly closed current paths during charging of the additional field-generating coil system and taking into consideration the diamagnetic expulsion of small field changes from the volume of the magnet coil system,
- $g_D^{eff,cl}$: Field contribution per ampere current of the additional field-generating coil system in the working volume taking into consideration the field contributions of the additional field-generating coil system itself and the field change due to currents induced in the superconducting magnet coil system and in additional superconductingly closed current paths during charging of the additional field-generating coil system while neglecting the diamagnetic expulsion of small field changes from the volume of the magnet coil system, –$\alpha$: average magnetic susceptibility in the volume of the magnet coil system with respect to field changes which do not exceed the amount of 0.1 T, wherein $0<\alpha\leqq 1$, $g^T=(g_M, g_{P1}, \ldots, g_{Pj}, \ldots, g_{Pn})$, $g_{Pj}$: Field per ampere of the current path Pj in the working volume without the field contributions of the current paths Pi for $i\neq j$, which react inductively to flux changes, and the magnet coil system, $g_M$: Field per ampere of the magnet coil system in the working volume without the field contributions of additional current paths which inductively react to flux changes, $g_D$: Field per ampere of the additional field-generating coil system in the working volume without the field contributions of additional current paths, which react inductively to flux changes, and of the magnet coil system, $L^{cl}$: Matrix of the inductive couplings between the magnet coil system and additional current paths which react inductively to flux changes, and among these additional current paths, $L^{cor}$: Correction for the inductance matrix $L^{cl}$, which would result with complete diamagnetic expulsion of disturbing fields from the volume of the magnet coil system, $L_{\leftarrow D}^{cl}$: Vector of inductive couplings of the additional field-generating coil system with the magnet coil system and the additional current paths which react inductively to flux changes, $L_{\leftarrow D}^{cor}$: Correction for the coupling vector $L_{\leftarrow D}^{cl}$, which would result with complete diamagnetic expulsion of disturbance fields from the volume of the magnet coil system.

In a preferred embodiment of the inventive magnet arrangement, the magnet arrangement is part of an apparatus for nuclear magnetic resonance spectroscopy, e.g. for EPR or NMR. Such apparatus require frequent modulation of the magnetic field in the working volume to sweep the resonance line in a so-called field sweep. This is usually effected with an additional coil system which supplements the magnet coil system and can be dimensioned particularly effectively in an arrangement in accordance with the invention.

One embodiment of the inventive magnet arrangement is particularly advantageous, wherein the superconducting magnet coil system comprises a radially inner and a radially outer coaxial coil system which are electrically connected in series, wherein these two coil systems each generate one magnet field in the working volume of opposing direction along the z axis. In such an arrangement, the magnetic shielding behavior of the superconductor in the magnet coil system typically has a particularly strong effect on the effective field strength $g_D^{eff}$ of certain additional field-generating coil systems in the working volume.

In a further development of this embodiment, the radially inner coil system and the radially outer coil system have dipole moments approximately equal in value and opposite in sign. This is the condition for optimum suppression of the stray field of the magnet coil system. Due to the great technical importance of actively shielded magnets, it is particularly advantageous that the effective field strength in the working volume $g_D^{eff}$ of additional field-generating coil systems can also be increased for magnets of this type through the diamagnetic shielding behavior of the superconductor in the magnet coil system in accordance with the invention.

In another advantageous further development of these embodiments, the magnet coil system forms a first current path which is superconductingly short-circuited during operation, and a disturbance compensation coil which is galvanically not connected to the magnet coil system is disposed coaxially to the magnet coil system to form a further current path which is superconductingly short-circuited during operation. The disturbance compensation coil improves the temporal stability of the magnetic field in the working volume in response to external field fluctuations. In such a further development of an inventive magnet arrangement, the influence of a disturbance compensation coil on the effective field strength in the working volume $g_D^{eff}$ of the additional field-generating coil system is taken into consideration.

In a further advantageous development, a part of the magnet coil system bridged with a superconducting switch forms a further current path which is superconductingly short-circuited during operation. An arrangement of this type improves the temporal stability of the magnetic field in the working volume in response to external field fluctuations. In such a further development of an inventive magnet arrangement the effect of bridging part of the magnet coil system with a superconducting switch on the effective field strength in the working volume $g_D^{eff}$ of an additional field-generating coil system is taken into consideration.

In a further advantageous development of the inventive magnet arrangement, a system for compensating the drift of the magnet coil system forms a further current path which is superconductingly short-circuited during operation. Such an arrangement improves the temporal stability of the magnetic field in the working volume. In this further development of the inventive magnet arrangement, the influence of drift compensation on the effective field strength in the working volume $g_D^{eff}$ of an additional field-generating coil system is taken into consideration.

In a further advantageous development, a shim device forms a further current path which is superconductly short-circuited during operation. Such an arrangement can compensate for field inhomogeneities. In this further development of the inventive magnet arrangement the influence of the superconducting shim device on the effective field strength $g_D^{eff}$ of an additional field-generating coil system in the working volume is taken into consideration.

In a particularly preferred embodiment of the inventive magnet arrangement, a device having a radially inner and a radially outer partial coil forms a further current path which is superconductingly short-circuited during operation, wherein the partial coils are connected in series and the radially outer partial coil has a considerably higher dipole moment per ampere current than the radially inner partial coil, wherein the radially inner partial coil generates a considerably larger magnetic field per ampere current in the working volume than the radially outer partial coil. Such a device can increase the effective field strength in the working volume $g_D^{eff}$ of an additional field-generating coil system if the additional field-generating coil system is disposed outside of the radially outer partial coil.

In a particularly advantageous further development of an inventive magnet arrangement, the additional field-generating coil system is normally conducting. In this arrangement, the additional field-generating coil system can advantageously be mounted in a room temperature region without influencing the cooling of the superconducting part of the magnet arrangement.

A further advantageous development of an inventive magnet arrangement is characterized in that the additional field-generating coil system is superconducting. In this arrangement, the current-carrying capacity of the additional field-generating coil system is advantageously larger than that of resistive coils.

In an advantageous further development of an inventive arrangement, the additional field-generating coil system is part of a device for modulating the magnetic field strength in the working volume. Dimensioning of such a coil system is particularly efficient in the inventive arrangement.

In a further advantageous development, the additional field-generating coil system is part of a so-called $Z^0$ shim, generating a substantially homogeneous magnetic field in the working volume. A current change in such a device compensates for a drift of the main coil system after a certain period of time without having to reset the current in the main coil system. The inventive arrangement permits particularly efficient dimensioning of such a device.

The present invention also concerns a method for dimensioning an inventive magnet arrangement which is characterized in that the variable $g_D^{eff}$, which corresponds to the field change in the working volume at z=0 per ampere current in the additional field-generating coil system, is calculated taking into consideration the magnetic fields produced by the currents induced in the residual magnet arrangement according to:

$$g_D^{eff}=g_D-g^T\cdot(L^{cl}-\alpha L^{cor})^{-1}\cdot(L_{\leftarrow D}^{cl}-\alpha L_{\leftarrow D}^{cor})$$

wherein the variables have the same, above-mentioned definitions. With this method for dimensioning a magnet arrangement having an additional field-generating coil system, the magnetic shielding behavior of the superconductor in the magnet coil system is advantageously taken into consideration. The method is based on the calculation of correction terms for the inductive couplings and for all self-inductances, which influence the respective quantities with a weighting factor $\alpha$. This method produces better agreement between calculated and measurable effective field strength in the working volume $g_D^{eff}$ of the additional field-generating coil system than with a method according to prior art. The magnet arrangement can be optimized by making $g_D^{eff}$ as large as possible while taking into account the magnetic shielding behavior of the superconductor in the magnet coil system.

In a simple variant of the inventive method, the parameter $\alpha$ corresponds to the volume portion of the superconducting material in the overall volume of the magnet coil system. This method for determining the parameter $\alpha$ is based on the assumption that the susceptibility in the superconductor with respect to small field changes is (−1) (ideal diamagnetism).

The values for $\alpha$ determined in this fashion cannot be confirmed experimentally for most magnet types. Therefore, in a particularly preferred alternative method variant, the parameter $\alpha$ is determined experimentally for the magnet coil system from the measurement of the variable $\beta^{exp}$ of the magnet coil system [without additional current paths which react inductively to flux changes] in response to a disturbance coil generating a substantially homogeneous disturbance field in the volume of the magnet coil system and through insertion of the variable $\beta^{exp}$ into the equation $$\alpha=\frac{(g_H(L_M^{cl}))^2(\beta^{exp}-\beta^{cl})}{g_H(\beta^{exp}-\beta^{cl})L_M^{cl}L_M^{cor}-g_M(L_{M\leftarrow H}^{cl}L_M^{cor}-L_{M\leftarrow H}^{cor}L_M^{cl})},$$

wherein $$\beta^{exp}=\frac{g_H^{exp}}{g_H},$$

$g_H^{exp}$: measured field change in the working volume of the magnet arrangement per ampere current in the disturbance coil, $$\beta^{cl}=1-g_M\cdot\left(\frac{L_{M\leftarrow H}^{cl}}{L_M^{cl}\cdot g_H}\right),\ \text{with}$$

$g_M$: Field per ampere of the magnet coil system in the working volume, $g_H$: Field per ampere of the disturbance coil in the working volume without the field contributions of the magnet coil system, $L_M^{cl}$: Inductance of the magnet coil system, $L_{M\leftarrow H}^{cl}$: Inductive coupling between the disturbance coil and the magnet coil system, $L_M^{cor}$: Correction for the inductance $L_M^{cl}$ of the magnet coil system, which would result with complete diamagnetic expulsion of disturbance fields from the volume of the magnet coil system, $L_{M\leftarrow H}^{cor}$: Correction for the inductive coupling $L_{M\leftarrow H}^{cl}$ of the disturbance coil with the magnet coil system which would result with complete diamagnetic expulsion of disturbance fields from the volume of the magnet coil system.

Finally, in a further particularly preferred variant of the inventive method, the corrections $L^{cor}$, $L_{\leftarrow D}^{cor}$, $L_M^{cor}$ and $L_{M\leftarrow D}^{cor}$ are calculated as follows:

$$L^{cor}=\begin{pmatrix} L_M^{cor} & L_{M\leftarrow P1}^{cor} & \cdots & L_{M\leftarrow Pn}^{cor} \\ L_{P1\leftarrow M}^{cor} & L_{P1}^{cor} & \cdots & L_{P1\leftarrow Pn}^{cor} \\ \vdots & \vdots & \ddots & \vdots \\ L_{Pn\leftarrow M}^{cor} & L_{Pn\leftarrow P1}^{cor} & \cdots & L_{Pn}^{cor} \end{pmatrix},$$

$$L_{\leftarrow D}^{cor}=\begin{pmatrix} L_{M\leftarrow D}^{cor} \\ L_{P1\leftarrow D}^{cor} \\ \vdots \\ L_{Pn\leftarrow D}^{cor} \end{pmatrix},$$

$$L_{Pj\leftarrow Pk}^{cor}=f_{Pj}(L_{(Pj,red,Ra_1)\leftarrow Pk}^{cl}-L_{(Pj,red,Ri_1)\leftarrow Pk}^{cl}),$$
$$L_{Pj\leftarrow D}^{cor}=f_{Pj}(L_{(Pj,red,Ra_1)\leftarrow D}^{cl}-L_{(Pj,red,Ri_1)\leftarrow D}^{cl}),$$
$$L_{Pj\leftarrow M}^{cor}=f_{Pj}(L_{(Pj,red,Ra_1)\leftarrow M}^{cl}-L_{(Pj,red,Ri_1)\leftarrow M}^{cl}),$$

$$L_{M\leftarrow Pj}^{cor}=L_{1\leftarrow Pj}^{cl}-L_{(1,red,Ri_1)\leftarrow Pj}^{cl}+\frac{Ra_1}{R_2}\left(L_{(2,red,Ra_1)\leftarrow Pj}^{cl}-L_{(2,red,Ri_1)\leftarrow Pj}^{cl}\right),$$

$$L_{M\leftarrow D}^{cor}=L_{1\leftarrow D}^{cl}-L_{(1,red,Ri1)\leftarrow D}^{cl}+\frac{Ra_1}{R_2}\left(L_{(2,red,Ra_1)\leftarrow D}^{cl}-L_{(2,red,Ri_1)\leftarrow D}^{cl}\right),$$

$$L_M^{cor}=L_{1\leftarrow 1}^{cl}-L_{(1,red,Ri1)\leftarrow 1}^{cl}+L_{1\leftarrow 2}^{cl}-L_{(1,red,Ri1)\leftarrow 2}^{cl}+\frac{Ra_1}{R_2}\left(L_{(2,red,Ra_1)\leftarrow 2}^{cl}-L_{(2,red,Ri_1)\leftarrow 2}^{cl}+L_{(2,red,Ra_1)\leftarrow 1}^{cl}-L_{(2,red,Ri_1)\leftarrow 1}^{cl}\right)$$

wherein $Ra_1$: Outer radius of the magnet coil system (in case of an actively shielded magnet coil system the outer radius of the main coil), $Ri_1$: Inner radius of the magnet coil system, $R_2$: in case of an actively shielded magnet coil system, the average radius of shielding, otherwise infinite, $R_{Pj}$: average radius of the additional coil Pj, $$f_{Pj} = \begin{cases} \frac{Ra_1}{R_{Pj}}, & R_{Pj} > Ra_1 \\ 1, & R_{Pj} < Ra_1 \end{cases}$$

and wherein the index 1 corresponds to the main coil for an actively shielded magnet coil system and otherwise represents the magnet coil system. The index 2 signifies the shielding for an actively shielded magnet coil system which in the absence thereof, is omitted. The index (X, red, R) designates a hypothetical coil X all of whose windings are located at radius R.

The particular advantage of this method for calculating the corrections $L^{cor}$, $L_{\leftarrow D}{}^{cor}$, $L_M{}^{cor}$ and $L_{M\leftarrow D}{}^{cor}$ consists in that the corrections are derived using the inductive couplings and self-inductances of coils and taking into consideration the geometric arrangement of the coils concerned.

Further advantages of the invention can be extracted from the description and the drawing. The features mentioned above and below can be used in accordance with the invention either individually or collectively in arbitrary combination. The embodiments shown and described are not to be considered to be exhaustive enumeration, but rather have exemplary character for describing the invention.

The invention is shown in the drawing and explained in more detail with reference to embodiments.

DESCRIPTION OF THE PREFERRED EMBODIMENT

Figure 1:
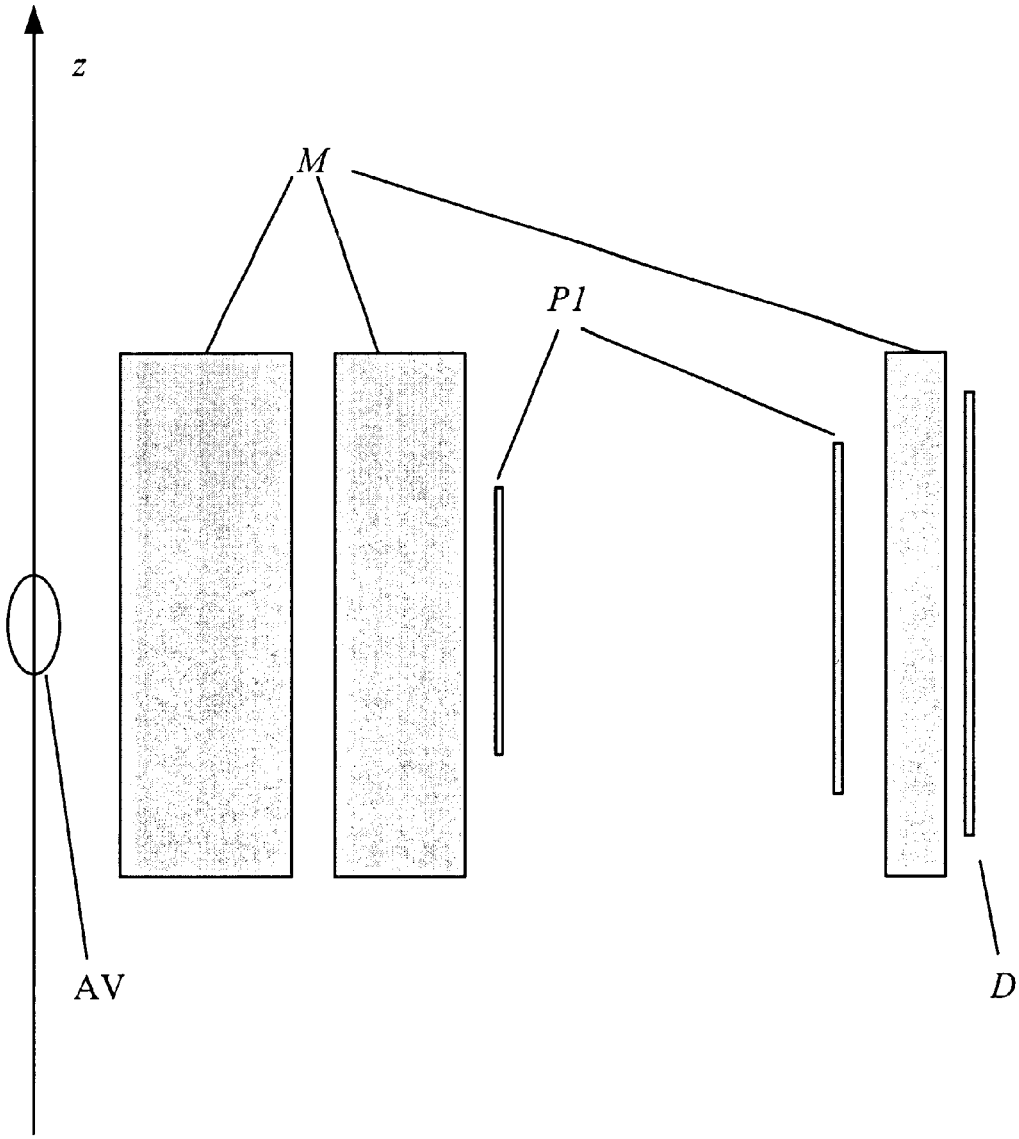
FIG. 1 shows a schematic vertical section through a radial half of the inventive magnet arrangement for generating a magnetic field in the direction of a z axis in a working volume AV disposed about z=0 with a superconducting magnet coil system M, an additional field-generating coil system D, and a further superconductingly closed current path P1.

As seen in FIG. 1, the superconducting magnet coil system M, the additional field-generating coil system D, and the further superconductingly closed current path P1 of a magnet arrangement in accordance with the invention can comprise several partial coils distributed at different radii. The partial coils can have different polarities. All partial coils are disposed coaxially about a working volume AV on an axis z about z=0. The small coil cross-section of the additional field-generating coil system D and the further superconductingly closed current path P1 in FIG. 1 indicates that the additional field-generating coil system D and the further superconductingly closed current path P1 only produce weak magnetic fields, with the main field being generated by the magnet coil system M.

Figure 2:
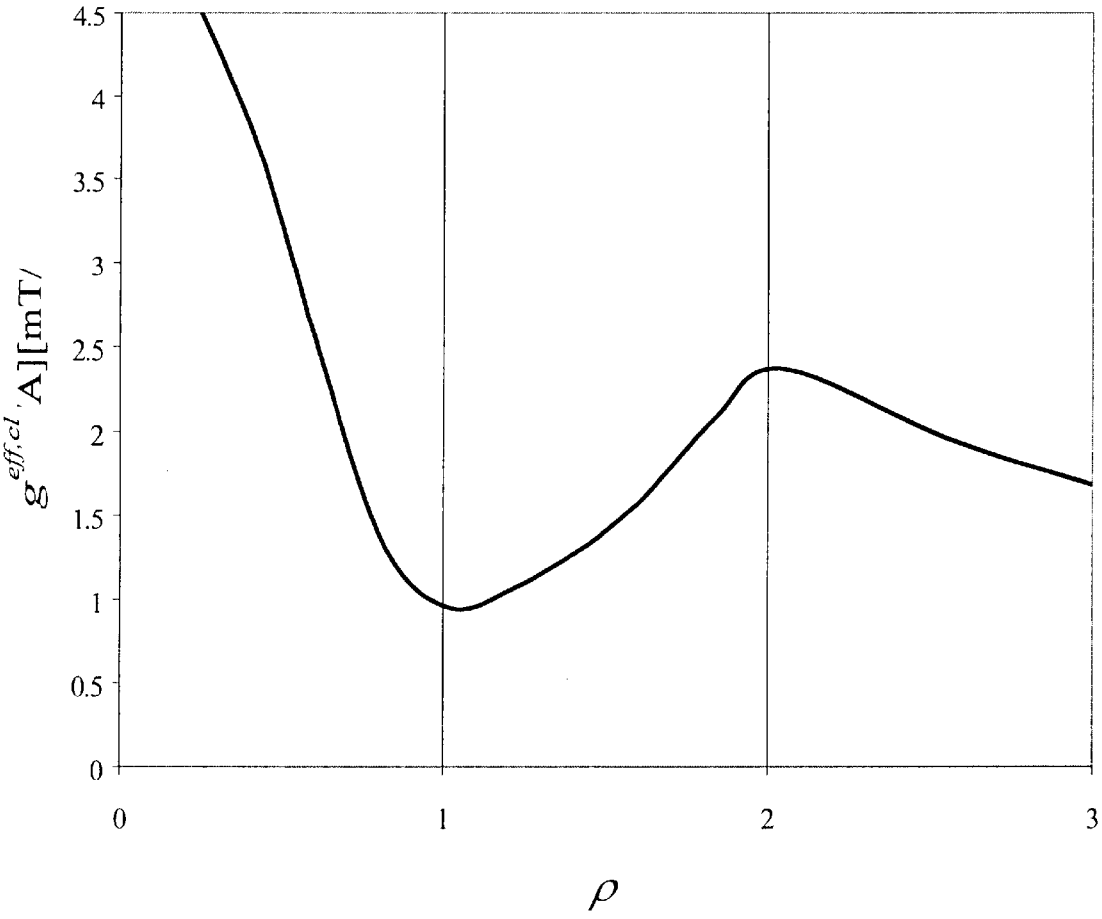
FIG. 2 shows the effective field strength $g^{eff,cl}$ per ampere current, calculated with a method according to prior art for one single partial coil of a field-generating coil system in an actively shielded superconducting magnet coil system without additional superconductingly closed current paths and as a function of the reduced radius ρ (radius normalized to the outside radius of the main coil of the magnet coil system) of the partial coil.
Figure 3:
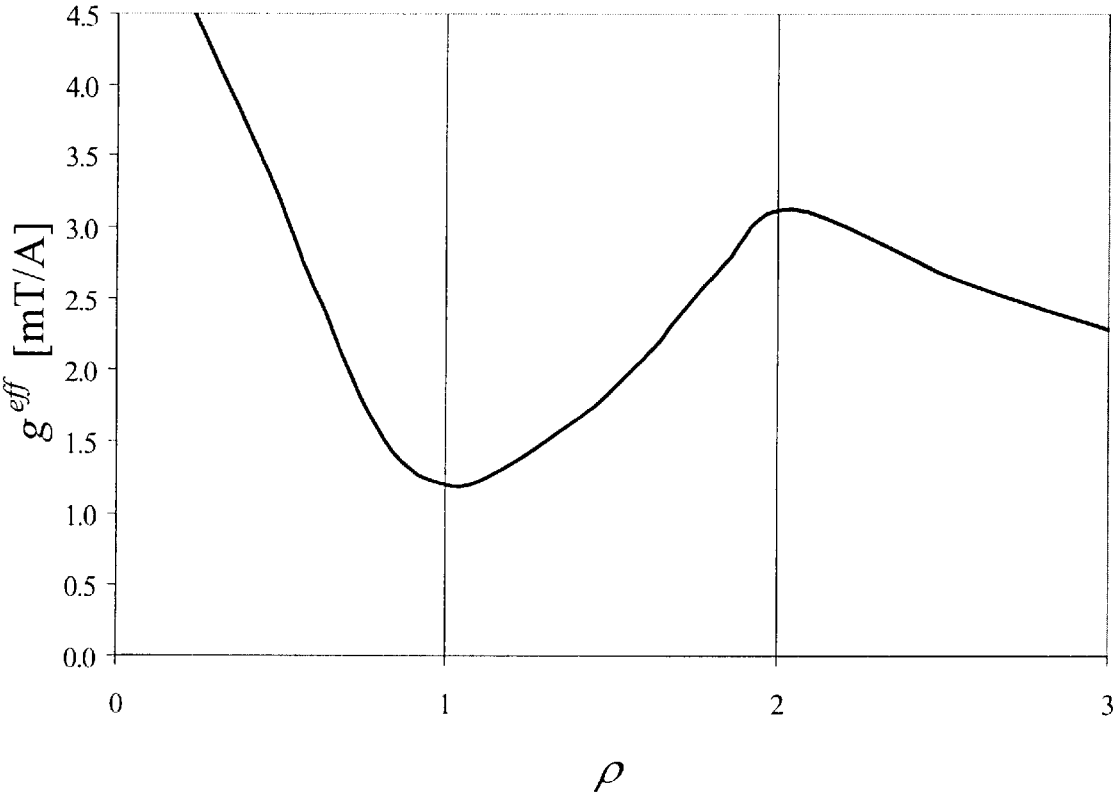
FIG. 3 shows the effective field strength $g^{eff}$ per ampere current calculated with the inventive method for a partial coil of a field-generating coil system in an actively shielded superconducting magnet coil system without additional superconductingly short-circuited current paths and as a function of the reduced radius ρ (radius normalized to the outer radius of the main coil of the magnet coil system) of the partial coil.
Figure 4:
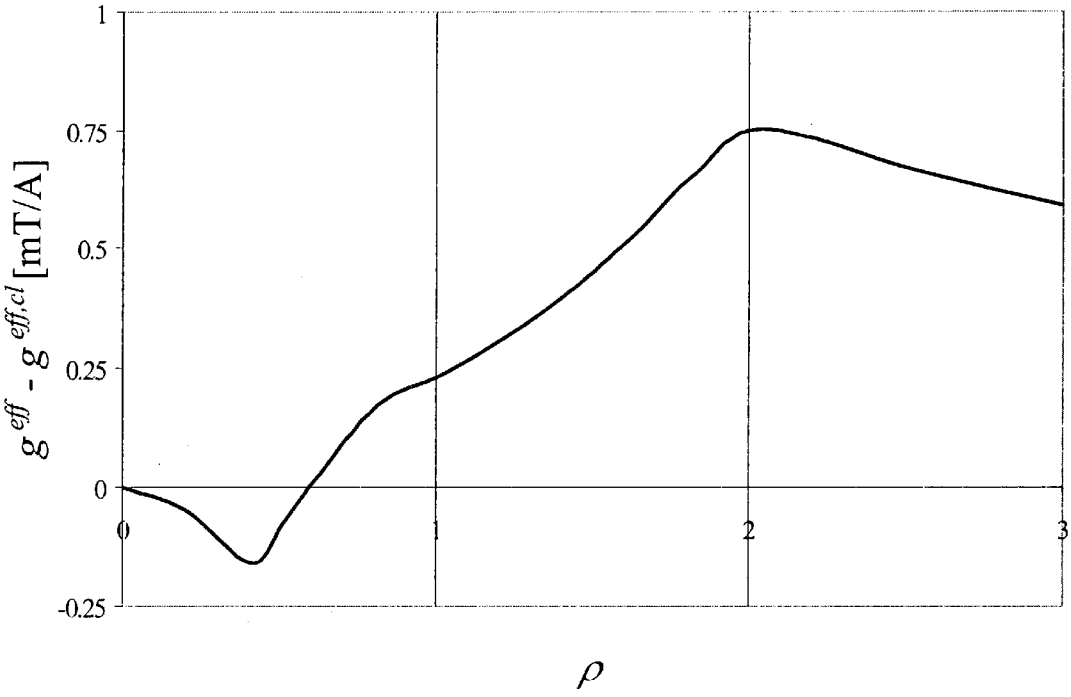
FIG. 4 shows the difference between the variables $g^{eff}$ and $g^{eff,cl}$ shown in FIGS. 2 and 3 as a function of the reduced radius ρ (radius normalized to the outer radius of the main coil) of the partial coil.

FIGS. 2 through 4 show the functions $g^{eff,cl}$ and $g^{eff}$ for one individual partial coil of a field-generating coil system in dependence on the radius of the partial coil. The partial coil has an axial length of 200 mm and consists of two layers with 400 wire windings each. Their central plane is at the height of the working volume at z=0. The variables $g^{eff,cl}$ and $g^{eff}$ correspond to the field contribution per ampere of the partial coil observed in the working volume at z=0 thereby taking into consideration the field contributions of the partial coil itself and the field change due to currents which are induced in the superconducting magnet coil system M during charging of the partial coil. $g^{eff,cl}$ was calculated with a method according to prior art and $g^{eff}$ was calculated with the inventive method. These calculations were carried out for a magnet arrangement having an actively shielded superconducting magnet coil system M and without additional superconductingly closed current paths. The radius of the active shielding is twice the outer radius of the main coil of the magnet coil system M. The dipole moments of the main coil and the shielding coil are equal in value and opposite in sign. A deviation of approximately 40 percent is obtained for the effective field strength per ampere at large radii of the partial coil of the field-generating coil system compared to a prior art method due to the correction terms, weighted with α=0.33 in correspondence with the method in accordance with the invention. The value α=0.33 roughly corresponds to the superconductor content of the coil volume of the magnet system.

To facilitate the following description, some terms are defined below:

An actively shielded superconducting magnet coil system M comprises a radially inner coil system C1, referred below to as the main coil, and a radially outer coil system C2, referred to below the as the shielding coil. These coils are axially symmetric about a z axis and generate magnetic fields of opposing directions in a volume on the axis about z=0 (in the following referred to as the working volume). An unshielded superconducting magnet coil system M is considered as a special case having a negligible outer coil system C2.

A disturbance field is either an electromagnetic disturbance which is produced outside of the magnet arrangement or a field which is generated by additional coils which do not belong to the magnet coil system M (e.g. coils of an additional field-generating coil system) and whose field contribution does not exceed 0.1 T.

To obtain formulas which are as compact and clear as possible, the following indices are used:

1 Main coil
2 Shielding coil
M Magnet coil system C1, C2
D additional field-generating coil system
H disturbance coil
P additional superconducting current path
cl variable calculated according to the cited prior art cor correction term in accordance with the present invention The indices P1, P2, . . . are used for additional superconducting current paths.

For calculating the effective field strength $g^{eff}$ per ampere current of an additional field-generating coil system D, the field contributions of the coil system itself and the field changes due to currents induced in the superconducting magnet coil system M and in the further superconductingly closed current paths during charging of the coil system D must be taken into consideration. To calculate the inductive reaction of the magnetic coil system M using a model of prior art (referred to as classical model below), the superconductor in the magnet coil system is modelled as a material without electrical resistance. The model on which the present invention is based takes into consideration additional magnetic properties of the superconductor. All superconducting magnet coil systems have these properties, but their influence on the effective field strength of additional coil systems D is particularly strong in actively shielded magnet coil system. The measured effective field strength of the additional coil system D in such magnet arrangements frequently fails to correspond to the classical model. The diamagnetic expulsion of small field changes can be utilized, to achieve particularly large effective field strengths from additional coil systems. Such coil systems can be e.g. $Z^0$ shims or field modulation coils.

Since the field of the superconducting magnet coil system in the working volume is larger by orders of magnitude than the field of additional coil systems (e.g. a $Z^0$ shim or a field modulation coil), only the component of the field of the additional coil systems which is parallel to the field of the magnet coil system (herein referred to as the z component) has a significant effect on the total field contribution. For this reason, only $B_z$-fields are considered below.

Upon generation of a disturbance field at the location of a superconducting magnet coil system M via a field-generating coil system D (e.g. during charging of a $Z^0$ shim or a field modulation coil), a current is induced in the superconductingly short-circuited magnet coil system according to Lenz's Law to generate a compensation field opposite to the disturbance field. The field change $\Delta B_{z,total}$ resulting in the working volume is a superposition of the disturbing field $\Delta B_{z,D}$ and of the compensation field $\Delta B_{z,M}$, i.e. $\Delta B_{z,total}=\Delta B_{z,D}+\Delta B_{z,M}$. With a current $\Delta I_D$ in the field-generating coil system D, the current $$\Delta I_M^{cl} = -\Delta I_D \cdot \frac{L_{M\leftarrow D}^{cl}}{L_M^{cl}}$$

is induced in the magnet coil system, wherein $L_M^{cl}$ is the (classical) self-inductance of the magnet coil system and $L_{M\leftarrow D}^{cl}$ the (classical) inductive coupling between magnet coil system and field-generating coil system. The effective field strength per ampere current in the field-generating coil system D in the working volume $g_D^{eff,cl}$ is the superposition of the field contribution per ampere $$g_D = \frac{\Delta B_{z,D}}{\Delta I_D}$$

of the coil system itself with the field change due to the current induced in the superconducting magnet coil system M per ampere current in the field-generating coil system D, i.e.:

$$g_D^{eff,cl} = g_D + g_M \Delta \frac{I_M^{cl}}{\Delta I_D} = g_D - g_M \frac{L_{M\leftarrow D}^{cl}}{L_M^{cl}}, \tag{1}$$

wherein $g_M$ is the field per ampere of the magnet coil system M in the working volume.

If there are further superconductingly short-circuited current paths P1, . . . ,Pn in the magnet arrangement in addition to the magnet coil system M and a field-generating coil system D (e.g. a $Z^0$ shim or a field modulation coil) the above formula is generalized to:

$$g_D^{eff,cl}=g_D-g^T\cdot(L^{cl})^{-1}\cdot L_{\leftarrow D}^{cl}, \tag{2}$$

wherein:

$g^T=(g_M,g_{P1}, \ldots ,g_{Pj}, \ldots ,g_{Pn})$, wherein:

$g_M$: Field per ampere of the magnet coil system M in the working volume without the field contributions of the currents induced in the additional current paths P1, . . . ,Pn, $g_{Pj}$: Field per ampere of the current path Pj in the working volume without the field contributions of the currents induced in the other additional current paths P1, . . . ,Pn and in the magnet coil system M, $$L^{cl} = \begin{pmatrix} L_M^{cl} & L_{M\leftarrow P1}^{cl} & \cdots & L_{M\leftarrow Pn}^{cl} \\ L_{P1\leftarrow M}^{cl} & L_{P1}^{cl} & \cdots & L_{P1\leftarrow Pn}^{cl} \\ \vdots & \vdots & \ddots & \vdots \\ L_{Pn\leftarrow M}^{cl} & L_{Pn\leftarrow P1}^{cl} & \cdots & L_{Pn}^{cl} \end{pmatrix}$$

Matrix of the (classical) inductive couplings between the magnet coil system M and the current paths P1, . . . ,Pn and among the current paths P1, . . . ,Pn.

$(L^{cl})^{-1}$ Inverse of the matrix $L^{cl}$, $$L_{\leftarrow D}^{cl} = \begin{pmatrix} L_{M\leftarrow D}^{cl} \\ L_{P1\leftarrow D}^{cl} \\ \vdots \\ L_{Pn\leftarrow D}^{cl} \end{pmatrix},$$

wherein:

$L_{Pj\leftarrow D}^{cl}$ (classical) inductive coupling of the current path Pj with the coil system D, $L_{M\leftarrow D}^{cl}$ (classical) inductive coupling of the magnet coil system M with the coil system D.

The classical inductive couplings and the self-inductances are modified by an additional amount by taking into consideration the above mentioned special magnetic properties of the superconductor. For this reason, the currents induced in the magnet coil system M and in the additional current paths P1, . . . ,Pn will generally assume values other than those calculated classically. These corrections are calculated below on the basis of a model of the magnetic behavior of the superconductor in the magnetic coil system.

It is known that type-I superconductors completely displace the magnetic flux from their inside (Meissner effect). With type-II superconductors, this is no longer the case above the lower critical field $H_{c1}$. According to the Bean model (C. P. Bean, Phys. Rev. Lett. 8, 250 (1962), C. P. Bean, Rev. Mod. Phys. 36, 31 (1964)) the magnetic flux lines adhere to the so-called "pinning centers". Small flux changes are trapped by the "pinning centers" on the surface of the superconductor and do not reach the inside of the superconductor which causes a partial expulsion of disturbance fields from the superconductor volume. A type-II superconductor reacts diamagnetically to small field changes while larger field changes largely penetrate the superconductor material.

To calculate the effect of this expulsion of small disturbance fields from the superconductor volume, we first assume that the main portion of the entire superconductor volume of a magnet arrangement is concentrated in the main coil and that the superconductor volume in the shielding coil and in the further superconducting coil systems can be neglected.

We also assume that all small field changes in the volume of the main coil are reduced by a constant factor $(1-\alpha)$ with $0<\alpha<1$ with respect to the value which they would have had without the diamagnetic shielding effect of the superconductor. However, we assume that there is no reduction of the disturbance fields in the free inner bore of the main coil (radius $Ri_1$) due to the superconductor diamagnetism. The field lines expelled from the main coil accumulate beyond the outer radius $Ra_1$ of the main coil such that the disturbance field is increased in this region. We assume that this disturbance field increase beyond $Ra_1$ decreases with increasing distance from the magnet axis from a maximum value at $Ra_1$ as $(1/r^3)$ (dipole behavior). The maximum value at $Ra_1$ is normalized such that the increase in the disturbance flux beyond $Ra_1$ exactly compensates the reduction in the disturbance flux within the superconducting volume of the main coil (conservation of flux).

The redistribution of magnetic flux through a superconductor volume with diamagnetic behavior in response to small field changes, alters the inductive couplings and self-inductances of the coils in the region of the superconductor volume. To extend the classical model for calculating the effective field strength of a field-generating coil system D (e.g. a $Z^0$ shim or a field modulation coil) while taking into consideration the influence of the superconductor diamagnetism, it is sufficient to determine the proper correction term for each coupling or self-inductance term in the formula $g_D^{eff,cl}=g_D-g^T\cdot(L^{cl})^{-1}\cdot L_{\leftarrow D}^{cl}$. The structure of the equation is not changed. The correction terms are derived below for all couplings and self-inductances.

The principle of calculating the correction terms is the same in all cases: determine the reduction in the magnetic flux change through a coil due to a small current change in another (or in itself) in the presence of diamagnetically reacting superconducting material in the main coil of the magnet coil system. The coupling between the first and second coil (or the self-inductance) is also correspondingly reduced. The size of the correction term depends on the size of the volume portion, filled by the superconducting material of the main coil, within the inductively reacting coil compared to the entire volume surrounded by the coil. The relative positions of the coils also influence the correction term for their mutual inductive coupling.

The introduction of "reduced coils" has proven to be a useful aid for calculating the correction terms. The coil X reduced to the radius R denotes the hypothetical coil which would be produced if all windings of the coil X were wound at the radius R. The index "X,red,R" is used for this coil. Using such reduced coils, when the flux through a coil changes, the contributions of the flux change through partial surfaces of this coil to the entire flux change can be calculated.

At first, the correction term for the coupling of a field-generating coil system D to the main coil C1 of the magnet coil system (shielded or unshielded) is calculated.

In the volume of the main coil C1, the disturbance field $\Delta B_{z,D}$ is reduced on average by the amount $\alpha\cdot\Delta B_{z,D}$, wherein $0<\alpha<1$ is a parameter which is still unknown. As a consequence, the disturbance flux through the main coil C1 and therefore the inductive coupling $L_{1\leftarrow D}$ between the main coil and the additional field-generating coil system is attenuated by a factor $(1-\alpha)$ with respect to the classical value $L_{1\leftarrow D}^{cl}$ if the disturbance field in the inner bore of the main coil is treated as also being reduced by the factor $(1-\alpha)$. We assume that the flux of the additional field-generating coil system is not expelled from the inner bore of the magnet. For this reason, the coupling between the additional field-generating coil system and the main coil must be supplemented by the amount erroneously subtracted from the inner bore. According to the definition of "reduced coils", this contribution is $\alpha\cdot L_{(1,red,Ri1)\leftarrow D}^{cl}$, wherein $L_{(1,red,Ri1)\leftarrow D}^{cl}$ is the coupling of the additional field-generating coil system with the main coil C1, reduced to its inner radius $Ri_1$. Taking into consideration the disturbance field expulsion from the superconducting volume of the main coil, the inductive coupling $L_{1\leftarrow D}$ of main coil and additional field-generating coil system is therefore:

$$L_{1\leftarrow D}=(1-\alpha)\cdot L_{1\leftarrow D}^{cl}+\alpha L_{(1,red,Ri1)\leftarrow D}^{cl} \tag{3}$$

The displaced flux reappears radially beyond the outer radius $Ra_1$ of the main coil. Assuming a dipole behavior for the displaced field (reduction with $(1/r^3)$), one obtains, in addition to the classical disturbance field, the following contribution outside of the main coil $$\alpha\frac{Ra_1}{r^3}\int_{Ri_1}^{Ra_1}\Delta B_{z,D}R\,dR. \tag{4}$$

This function is normalized such that the entire flux of the disturbance field through a large loop with a radius R for $R\rightarrow\infty$ approaches zero. The disturbance field $\Delta B_{z,D}$ is assumed to be cylindrically symmetric.

If the magnet coil system is actively shielded, the disturbance flux through the shielding coil C2 is also reduced due to expulsion of the disturbance flux from the main coil C1. The disturbance flux through a winding of radius $R_2$ at an axial height $z_0$ is reduced with respect to the classical case (integral of (4) over the region $r>R_2$) by the following amount:

$$2\pi\alpha\int_{R_2}^{\infty}\frac{Ra_1}{r^2}dr\int_{Ri_1}^{Ra_1}\Delta B_z^D R\,dR=2\pi\alpha\frac{Ra_1}{R_2}\int_{Ri_1}^{Ra_1}\Delta B_z^D R\,dR$$
$$=\alpha\frac{Ra_1}{R_2}\left(\Phi_{(2,red,Ra_1)\leftarrow D}^{cl}-\Phi_{(2,red,Ri_1)\leftarrow D}^{cl}\right)$$

$\Phi_{(2,red,Ra_1)\leftarrow D}^{cl}$ characterizes herein the classical disturbance flux through a loop of radius $Ra_1$, which is at the same axial height $z_0$ as the observed loop of radius $R_2$ (analog for $Ri_1$). Summing over all windings of the shielding coil (which are approximately all at the same radius $R_2$) results in a new mutual coupling of the additional field-generating coil system with the shielding coil:

$$L_{2\leftarrow D}=L_{2\leftarrow D}^{cl}-\alpha\frac{Ra_1}{R_2}\left(L_{(2,red,Ra_1)\leftarrow D}^{cl}-L_{(2,red,Ri_1)\leftarrow D}^{cl}\right)$$

$L_{(2,red,Ra_1)\leftarrow D}^{cl}$ therein designates the classical coupling of the additional field-generating coil system with the shielding "reduced" to the radius $Ra_1$ (analogous for $Ri_1$). As a result of this "reduction", together with the multiplicative factor $Ra_1/R_2$, the coupling $L_{2\leftarrow D}$ is less attenuated with respect to the classical value $L_{2\leftarrow D}^{cl}$ than is $L_{1\leftarrow D}$ with respect to $L_{1\leftarrow D}^{cl}$. Since the main and shielding coils are electrically connected in series, the inductive reaction of the shielding coil exceeds the one of the main coil in the overall reaction of the magnet coil system to the small field change.

In total, the new coupling of the additional field-generating coil system D with the magnet coil system M, is given by $$L_{M\leftarrow D}=L_{M\leftarrow D}^{cl}-\alpha L_{M\leftarrow D}^{cor} \tag{5}$$

with $$L_{M\leftarrow D}^{cor}=L_{1\leftarrow D}^{cl}-L_{(1,red,Ri1)\leftarrow D}^{cl}+\frac{Ra_1}{R_2}\left(L_{(2,red,Ra_1)\leftarrow D}^{cl}-L_{(2,red,Ri_1)\leftarrow D}^{cl}\right)$$

Analogous to the main coil, the disturbance flux is also expelled from the superconducting volume of the shielding. Since this volume is normally small compared to the superconducting volume of the main coil, this effect can be neglected.

Whether the disturbance field is generated inside or outside of the magnet arrangement or through a small current change in the magnet coil system itself, is irrelevant for the mechanism of flux displacement. For this reason, the self-inductance of the magnet coil system also changes compared to the classical case. In particular:

$$L_{1\leftarrow 1}=(1-\alpha)L_{1\leftarrow 1}^{cl}+\alpha L_{(1,red,Ri_1)\leftarrow 1}^{cl}$$

$$L_{1\leftarrow 2}=(1-\alpha)L_{1\leftarrow 2}^{cl}+\alpha L_{(1,red,Ri_1)\leftarrow 2}^{cl}$$

The other inductances change as follows:

$$L_{2\leftarrow 2}=L_{2\leftarrow 2}^{cl}-\alpha\frac{Ra_1}{R_2}\left(L_{(2,red,Ra_1)\leftarrow 2}^{cl}-L_{(2,red,Ri_1)\leftarrow 2}^{cl}\right)$$

$$L_{2\leftarrow 1}=L_{2\leftarrow 1}^{cl}-\alpha\frac{Ra_1}{R_2}\left(L_{(2,red,Ra_1)\leftarrow 1}^{cl}-L_{(2,red,Ri_1)\leftarrow 1}^{cl}\right)$$

The new overall inductance of the magnet coil system is $$L_M=L_M^{cl}-\alpha L_M^{cor} \tag{6}$$

with $$L_M^{cor}=L_{1\leftarrow 1}^{cl}-L_{(1,red,Ri1)\leftarrow 1}^{cl}+L_{1\leftarrow 2}^{cl}-L_{(1,red,Ri1)\leftarrow 2}^{cl}+\frac{Ra_1}{R_2}\left(L_{(2,red,Ra_1)\leftarrow 2}^{cl}-L_{(2,red,Ri_1)\leftarrow 2}^{cl}+L_{(2,red,Ra_1)\leftarrow 1}^{cl}-L_{(2,red,Ri_1)\leftarrow 1}^{cl}\right)$$

Insertion of the corrected coupling $L_{M\leftarrow D}$ between magnet and coil system D in accordance with equation (5) instead of the classical inductive coupling $L_{M\leftarrow D}^{cl}$ and the corrected self-inductance $L_M$ in accordance with equation (6) instead of the classical self-inductance $L_M^{cl}$ gives:

$$g_D^{eff}=g_D-g_M\cdot\frac{L_{M\leftarrow D}^{cl}-\alpha L_{M\leftarrow D}^{cor}}{L_M^{cl}-\alpha L_M^{cor}} \tag{7}$$

The above formulas are generalized below to the case where additional current paths P1, . . . ,Pn are present.

For the direction M←Pj (a current change in Pj induces a current in M) the couplings between the magnet coil system and the additional current paths Pj (j=1, . . . , n) are reduced to the same extent as the corresponding couplings between the magnet coil system and an additional field-generating coil system:

$$L_{M\leftarrow Pj}=L_{M\leftarrow Pj}^{cl}-\alpha L_{M\leftarrow Pj}^{cor} \tag{8}$$

wherein $$L_{M\leftarrow P_j}^{cor}=L_{1\leftarrow P_j}^{cl}-L_{(1,red,Ri_1)\leftarrow P_j}^{cl}+\frac{Ra_1}{R_2}\left(L_{(2,red,Ra_1)\leftarrow P_j}^{cl}-L_{(2,red,Ri_1)\leftarrow P_j}^{cl}\right)$$

The new coupling $L_{Pj\leftarrow M}$ (a current change in M induces a current in Pj) is calculated:

$$L_{Pj\leftarrow M}=L_{Pj\leftarrow M}^{cl}-\alpha L_{Pj\leftarrow M}^{cor} \tag{9}$$

with $$L_{Pj\leftarrow M}^{cor}=f_{Pj}(L_{(Pj,red,Ra_1)\leftarrow M}^{cl}-L_{(Pj,red,Ri_1)\leftarrow M}^{cl})$$

For $R_{Pj}>Ra_1$ the coil Pj "reduced" to $Ra_1$ is once more defined in such a manner that all windings are reduced to the smaller radius $Ra_1$ (analogous for $Ri_1$). If, however, $Ri_1<R_{Pj}<Ra_1$, we take the coil "reduced" to $Ra_1$ as the coil Pj (the windings are not expanded to $Ra_1$). For $R_{Pj}<Ri_1$ we also take the coil "reduced" to $Ri_1$ as the coil Pj, i.e. in this case, the correction term for classical theory equals zero.

For $R_{Pj}>Ra_1$ the constant $f_{Pj}$ is calculated from integration of (4) over the region $r>R_{Pj}$. For $R_{Pj}\leqq Ra_1$, $f_{Pj}=1$:

$$f_{Pj}=\begin{cases}\frac{Ra_1}{R_{Pj}}, & R_{Pj}>Ra_1\\ 1, & R_{Pj}\le Ra_1\end{cases}$$

The corrections due to the properties of the superconductor therefore lead to asymmetric inductance matrices ($L_{M\leftarrow Pj}\neq L_{Pj\leftarrow M}$!).

The coupling $L_{Pj\leftarrow D}$ between an additional superconducting current path Pj and the field-generating coil system D is also influenced to a greater or lesser degree by expulsion of the flux of the disturbance field of the coil system D from the superconductor material of the main coil:

$$L_{Pj\leftarrow D}=L_{Pj\leftarrow D}^{cl}-\alpha L_{Pj\leftarrow D}^{cor} \tag{10}$$

with $$L_{Pj\leftarrow D}^{cor}=f_{Pj}(L_{(Pj,red,Ra_1)\leftarrow D}^{cl}-L_{(Pj,red,Ri_1)\leftarrow D}^{cl})$$

According to the same principle, the couplings between the additional superconducting current paths are also reduced to greater or lesser degrees (note the order of indices):

$$L_{Pj\leftarrow Pk}=L_{Pj\leftarrow Pk}^{cl}-\alpha L_{Pj\leftarrow Pk}^{cor} \tag{11}$$

with $$L_{Pj\leftarrow Pk}^{cor}=f_{Pj}(L_{(Pj,red,Ra_1)\leftarrow Pk}^{cl}-L_{(Pj,red,Ri_1)\leftarrow Pk}^{cl})\ (j=1,\ldots,n;\ k=1,\ldots,n).$$

In particular, the self-inductances (j=k) of the additional superconducting current paths are also influenced.

The actual field contribution $g_D^{eff}$ per ampere current of a field-generating coil system D in the working volume is calculated with equation (2) for the classical field efficiency $g_D^{eff,cl}$ of the coil system D, wherein the corrected values for the couplings $L_{M\leftarrow D}$, $L_{M\leftarrow Pj}$, $L_{Pj\leftarrow M}$, $L_{Pj\leftarrow D}$ and $L_{Pj\leftarrow Pk}$ are introduced according to (5), (8), (9), (10) and (11):

$$g_D^{eff}=g_D-g^T\cdot(L^{cl}-\alpha L^{cor})^{-1}\cdot(L_{\leftarrow D}^{cl}-\alpha L_{\leftarrow D}^{cor})$$

wherein:

$g_D^{eff}$: Field contribution per ampere current of the coil system D in the working volume at z=0 thereby taking into consideration the field contribution of the coil system itself and the field change due to currents which are induced in the superconducting magnet coil system M and in the further superconductingly closed current paths P1, . . . ,Pn during charging of the coil system D, thereby taking into consideration a diamagnetic expulsion of small field changes from the volume of the magnet coil system M, $-\alpha$: average magnetic susceptibility in the volume of the magnetic coil system M with respect to field changes which do not exceed 0.1 T; wherein $0<\alpha\leqq 1$, $g^T=(g_M, g_{P1}, \ldots, g_{Pj}, \ldots, g_{Pn})$, $g_{Pj}$: Field per ampere of the current path Pj in the working volume without the field contributions of the current paths Pi for $i\neq j$ and of the magnet coil system M and without the field contributions of the coil system D, $g_M$: Field per ampere of the magnet coil system M in the working volume without the field contributions of the current paths P1, . . . ,Pn and without the field contributions of the coil system D, $g_D$: Field per ampere of the coil system D in the working volume without the field contributions of the current paths P1, . . . ,Pn and the magnet coil system M, $L^{cl}$: Matrix of the inductive couplings between the magnet coil system M and the current paths P1, . . . ,Pn and among the current paths P1, . . . ,Pn, $L^{cor}$: Correction for the inductance matrix $L^{cl}$, which would result with complete diamagnetic displacement of disturbance fields from the volume of the magnet coil system M, $L_{\leftarrow D}^{cl}$: Vector of the inductive couplings of the coil system D with the magnet coil system M and the current paths P1, . . . ,Pn, $L_{\leftarrow D}^{cor}$: Correction for the coupling vector $L_{\leftarrow D}^{cl}$, which would result with complete diamagnetic displacement of disturbance fields from the volume of the magnet coil system M.

If a current path Pj comprises partial coils at different radii, the matrix elements in the correction terms $L^{cor}$ and $L_{\leftarrow D}^{cor}$, which belong to Pj, must be calculated such that each partial coil is initially treated as an individual current path and the correction terms of all partial coils are then added together. This sum is the matrix element of the current path Pj.

The coil systems D of interest are mainly $Z^0$ shims or field modulation coils. The field efficiency $g_D^{eff}$ of such a coil system should normally be as large as possible. The above-described formalism optimizes the additional field-generating coil system and the remaining magnet arrangement such that this field efficiency is maximized.

In many superconducting magnet arrangements M, D, P1, . . . , Pn, with a magnet coil system M, an additional field-generating coil system D and with additional superconductingly closed current paths P1, . . . , Pn, there is no large difference between the classically calculated field efficiency $g_D^{eff,cl}$ and the field efficiency $g_D^{eff}$ calculated in accordance with the inventive method. A magnet arrangement, wherein the magnetic shielding behavior of the superconducting material in the magnet coil system with respect to small field changes has considerable effect on the field efficiency $g_D^{eff}$ of the additional field-generating coil system, is an actively shielded magnet coil system with a main coil C1 and a shielding coil C2.

FIGS. 2 through 4 show that the partial coils of a field-generating coil system exhibit classical behavior as long as they are in the region of the main coil C1 of the actively shielded magnet coil system. Their effective field efficiency is increased by the magnetic shielding behavior of the superconducting material in the magnet coil system if they are further radially outward. This effect can be utilized to mount an effective additional field-generating coil system at a large radius, thereby gaining space for the magnet coil system at smaller radii.

In a first approximation, the parameter $\alpha$ is the superconductor portion of the volume of the main coil C1. The most precise manner of determining the parameter $\alpha$ is to carry out a disturbance experiment on the magnet coil system M without additional superconducting current paths P1, . . . , Pn. Disturbance coils having a large radius are particularly well suited therefor. The following procedure is advantageous:

1. Experimental determination of the value $$\beta^{exp} = \frac{g_H^{exp}}{g_H}$$

of the magnet coil system with respect to a disturbance which is substantially homogeneous in the region of the magnet coil system (e.g. with a disturbance coil H at a large radius), wherein $g_H^{exp}$: The measured field change in the working volume of the magnet arrangement per ampere current in the disturbance coil H, $g_H$: Field per ampere of the disturbance coil H in the working volume without the field contributions of the magnet coil system M, 2. Determination of the value $$\beta^{cl} = 1 - g_M \cdot \left( \frac{L_{M\leftarrow H}^{cl}}{L_M^{cl} \cdot g_H} \right)$$

with respect to the same disturbance coil, wherein $g_M$: Field per ampere of the magnet coil system M in the working volume, $L_M^{cl}$: Inductance of the magnet coil system M, $L_{M\leftarrow H}^{cl}$: Inductive coupling of the disturbance coil H with the magnet coil system M, 3. Determination of the parameter $\alpha$ from equation $$\alpha = \frac{(g_H(L_M^{cl}))^2(\beta^{exp} - \beta^{cl})}{g_H(\beta^{exp} - \beta^{cl})L_M^{cl}L_M^{cor} - g_M(L_{M\leftarrow H}^{cl}L_M^{cor} - L_{M\leftarrow H}^{cor}L_M^{cl})}$$

wherein $L_M^{cor}$: Correction for the magnet inductance $L_M^{cl}$, which would result with complete diamagnetic expulsion of disturbance fields from the volume of the magnet coil system M, $L_{M\leftarrow H}^{cor}$: Correction for inductive coupling $L_{M\leftarrow H}^{cl}$ of the disturbance coil H with the magnet coil system M, which would result with complete diamagnetic expulsion of disturbance fields from the volume of the magnet coil system M.

We claim:

1. A magnet device (M, D, P1, . . . , Pn) for generating a magnetic field in the direction of a z axis in a working volume disposed about z=0, the device comprising:

a magnet coil system (M) with at least one current-carrying superconducting magnet coil;

an additional coil system (D) which can be fed via an external current source to generate a magnetic field in the working volume which differs substantially from zero; and at least one additional superconductingly closed current paths (P1, . . . , Pn), wherein a total magnetic field in the z direction generated in the working volume by said additional current paths (P1, . . . , Pn) due to currents induced during operation plus the field of said additional coil system (D) does not substantially exceed 0.1 Tesla with $$|g_D^{eff}|>1.2\cdot|g_D^{eff,cl}|, \text{ wherein}$$

$$g_D^{eff}=g_D-g^T\cdot(L^{cl}-\alpha L^{cor})^{-1}\cdot(L_{\leftarrow D}^{cl}-\alpha L_{\leftarrow D}^{cor})$$

$$g_D^{eff,cl}=g_D-g^T\cdot(L^{cl})^{-1}\cdot L_{\leftarrow D}^{cl}$$

, with the variables being defined as follows:

$g_D^{eff}$: Field contribution per ampere current of said additional coil system (D) in the working volume thereby taking into consideration the field contributions of said additional coil system (D) itself and also of a field change due to currents which are induced in said superconducting magnet coil system (M) and in said further superconductingly closed current paths (P1, . . . ,Pn) during charging of said additional coil system (D) thereby taking into consideration a diamagnetic expulsion of disturbance fields from a volume of the magnet coil system (M), $g_D^{eff,cl}$: Field contribution per ampere current of said additional coil system (D) in the working volume thereby taking into consideration the field contributions of the additional coil system (D) itself and of a field change due to currents which are induced in said superconducting magnet coil system (M) and in said further superconductingly closed current paths (P1, . . . ,Pn) during charging of said additional coil system (D), thereby neglecting said diamagnetic expulsion of disturbance fields from said volume of the magnet coil system (M), $-\alpha$: average magnetic susceptibility in said volume of said magnet coil system (M) with respect to field fluctuations which do not exceed 0.1 T, wherein $0<\alpha\leqq 1$, $g^T=(g_M,g_{P1}, \ldots ,g_{Pj}, \ldots ,g_{Pn})$, $g_{Pj}$: Field per ampere of said current path Pj in the working volume without field contributions of said current paths Pi for $i\neq j$ and of said magnet coil system (M), $g_M$: Field per ampere of said magnet coil system (M) in the working volume without field contributions of said current paths (P1 , . . . ,Pn), $g_D$: Field per ampere of said additional coil system (D) in the working volume without field contributions of said current paths (P1, . . . ,Pn) and of said magnet coil system (M), $L^{cl}$: Matrix of inductive couplings between said magnet coil system (M) and said current paths (P1, . . . ,Pn) and among said current paths (P1, . . . ,Pn), $L^{cor}$: Correction for said inductance matrix $L^{cl}$, which would result with complete diamagnetic expulsion of disturbance fields from said volume of said magnetic coil system (M), $L_{\leftarrow D}^{cl}$: Vector of inductive couplings of said additional coil system (D) with said magnet coil system (M) and said current paths (P1, . . . ,Pn), $L_{\leftarrow D}^{cor}$: Correction for said coupling vector $L_{\leftarrow D}^{cl}$, which would result with complete diamagnetic expulsion of disturbance fields from said volume of said magnet coil system (M).

2. The magnet device of claim 1, wherein said additional coil system (D) generates a magnetic field in the working volume which is larger than 0.2 millitesla per ampere current.

3. The magnet device of claim 1, wherein said magnet device is part of an apparatus for magnetic resonance spectroscopy.

4. The magnet device of claim 1, wherein said superconducting magnet coil system (M) comprises coaxial radially inner and radially outer coil systems (C1,C2) which are electrically connected in series, wherein each of said radially inner and said radially outer coil systems produces one magnetic field of mutually opposing direction along the z axis in the working volume.

5. The magnet device of claim 4, wherein said radially inner coil system (C1) and said radially outer coil system (C2) have dipole moments approximately equal in value and opposite in sign.

6. The magnet device of claim 1, wherein said magnet coil system (M) forms a first current path which is superconductingly short-circuited during operation and wherein said additional superconductingly short-circuited current paths (P1, . . . , Pn) comprise a disturbance compensation coil which is not galvanically connected to said magnet coil system (M) and which is disposed coaxially to said magnet coil system (M).

7. The magnet device of claim 1, wherein at least one of said additional current paths (P1, . . . ,Pn) is a part of said magnet coil system (M) which is bridged with a superconducting switch.

8. The magnet device of claim 1, wherein at least one of said additional current paths (P1, . . . ,Pn) is part of a system for compensating a drift of said magnet coil system (M).

9. The magnet device of claim 1, wherein at least one of said additional current paths (P1, . . . Pn) is part of a superconducting shim device.

10. The magnet device of claim 1, wherein at least one of said additional current paths (P1, . . . Pn) comprises a radially inner and a radially outer partial coil which are connected in series, wherein said radially outer partial coil has a substantially higher dipole moment per ampere current than said radially inner coil, and wherein said radially inner partial coil produces a substantially larger magnetic field per ampere current in the working volume than said radially outer coil.

11. The magnet device of claim 1, wherein said additional coil system (D) is normally conducting.

12. The magnet device of claim 1, wherein said additional coil system (D) is superconducting.

13. The magnet device of claim 1, wherein said additional coil system (D) is part of a device for modulating a magnetic field strength in the working volume.

14. The magnet device of claim 12, wherein said additional coil system (D) is part of a $Z^0$ shim to produce a substantially homogeneous magnetic field in the working volume.

* * * * *